United States Patent [19]

Holman et al.

[11] 4,019,540

[45] Apr. 26, 1977

[54] LOOM FOR PRODUCING THREE DIMENSIONAL WEAVES

[75] Inventors: Harry A. Holman, Ladue; Albert W. Kallmeyer, Crestwood; Henry C. Paulsen, Chesterfield, all of Mo.; William W. Weaver, Detroit Lakes, Minn.

[73] Assignee: McDonnell Douglas Corporation, St. Louis, Mo.

[22] Filed: Mar. 12, 1976

[21] Appl. No.: 666,241

[52] U.S. Cl. ..... 139/20; 139/35; 139/DIG. 1

[51] Int. Cl.[2] ..... D03D 41/00

[58] Field of Search ..... 139/1, 11, 12, 13, 20, 139/22, 35, 55, DIG. 1

[56] References Cited

UNITED STATES PATENTS

| | | | |
|---|---|---|---|
| 3,217,752 | 11/1965 | Sutcliffe | 139/20 |
| 3,237,650 | 3/1966 | Dickerson | 139/20 |
| 3,799,209 | 3/1974 | Dow et al. | 139/DIG. 1 |
| 3,818,951 | 6/1974 | Greenwood | 139/20 |
| 3,904,464 | 9/1975 | King | 139/11 |

*Primary Examiner*—Henry S. Jaudon
*Attorney, Agent, or Firm*—Gravely, Lieder & Woodruff

[57] ABSTRACT

A loom includes a take-up assembly to which the forward ends of longitudinal strands are attached and a tensioning assembly to which the rear ends of the strands are connected. The tensioning assembly maintains the strands taut and further arranges the strands in a predetermined array in which a plurality of strands exist in both crosswise directions. A shedding assembly is located between the take-up assembly and tensioning assembly and includes a plurality of vertical wires which pass crosswise through the array and a plurality of horizontal wires which also pass crosswise through the array. The vertical and horizontal wires are arranged in pairs with the two wires of each pair being on opposite sides of the longitudinal centerline for the array and spaced equally therefrom. Each pair of wires is supported on a single cable system having an actuator. The actuator when energized moves the cable system such that the wires either move together or spread apart. Since the wires pass through the array crosswise, shed openings are created in the array. Horizontal and vertical strands may be passed through these shed openings to create a three dimensional weave. The completed weave is confined in a weave guide which is located in a fixed position ahead of the shedding assembly. The take-up assembly and tensioning assembly move relative to the shedding assembly and weave guide as the weave grows progressively longer. The take-up assembly may be provided with a shaping device for creating a curved weave.

24 Claims, 15 Drawing Figures

LOOM FOR PRODUCING THREE DIMENSIONAL WEAVES

BACKGROUND OF THE INVENTION

This invention relates in general to weaving and more particularly to a loom for producing three dimensional weaves.

Three dimensional weaves, in contrast to conventional two dimensional weaves which are most commonly associated with fabrics, have substantial thickness by reason of the fact that the yarns or strands which make up the weave extend in three directions. Comparing the weave with a cartesian coordinate system, some of the yarns extend in the X direction, moe of the yarns extend in the Y direction, and still more extend in the Z direction. The individual strands of Y and Z yarns are woven through the parallel strands X yarns, thus creating the weave.

These weaves when impregnated with suitable resins or graphitic materials produce extremely light weight and strong composite structures which are useful in the aero-space industry as well as others. Moreover, when the yarns are of the ablative variety, such as high modulus carbon or graphite, the composite structure is capable of withstanding extremely high temperatures.

Heretofore, three dimensional weaves have been produced, but the procedures for creating such weaves have been almost entirely manual operations. As a result, they are extremely tedious and time-consuming. One procedure involves pushing hollow needles through stacked layers of previously woven cloth and inserting yarn of the third direction through these needles. From a practical standpoint, the needle cannot be over about 18 inches in length, and as a result, the process is not suitable for producing woven configurations of substantial length. Furthermore, current weaving procedures require making rather sharp bends in the yarns as they are woven together. However, ablative yarns break relatively easily when sharply bent, and this substantially increases the time and difficulty of the process.

SUMMARY OF THE INVENTION

One of the principal objects of the present invention is to provide a loom having a shedding mechanism which enables the loom to produce three dimensional weaves. Another object is to provide a loom of the type stated which produces a three dimensional weave without imparting sharp bends to the strands or excessively manipulating the strands. A further object is to provide a loom of the type stated in which the shedding mechanism is capable of handling a large number of strands, yet is highly compact. An additional object is to provide a loom of the type stated in which the shedding mechanism creates two sheds in the strands when a single actuator is energized. Still another object is to provide a loom capable of manipulating fragile strands or yarns such as high modulus carbon and graphite yarns as well as quartz and silica yarns. Yet another object is to provide a loom capable of producing weaves of relatively large cross section. These and other objects and advantages will become apparent hereinafter.

The present invention is embodied in a weaving machine having a shedding apparatus which includes first elongated elements extended crosswise through an array of longitudinal strands, a plurality of second elongated elements also extended crosswise through the array of longitudinal strands, but at an angle to the first strands, and means for moving the elements between inner and outer positions so as to increase the spacing between selected adjacent strands in the array, thereby creating shed openings in the array. The invention also resides in a shedding apparatus including a cable having inner and outer passes located beyond one side of an array of longitudinal strands and more inner and outer passes located beyond the opposite side of the array, a first wire extended between the inner passes and passing crosswise through the array, a second wire extended between the outer passes and likewise passing crosswise through the array, and an actuator for moving the cable, whereby the wires will move either apart or together depending on the direction in which the actuator moves the cable. The invention further resides in a weaving machine having a take-up assembly and tensioning assembly between which the longitudinal strands are stretched with the tensioning assembly maintaining the strands taut and in an array having thickness in both crosswise directions, the shedding assembly being located between the take-up and tension assemblies and having a plurality of first wires which pass through the array in one crosswise direction and a plurality of second wires which pass through the array at 90° to the first wires, and means for moving the first and second wires to create shed openings in the array. The invention also consists in the parts and in the arrangements and combinations of parts hereinafter described and claimed.

DESCRIPTION OF THE INVENTION

In the accompanying drawings which form part of the specification and wherein like numerals and letters refer to like parts wherever they occur:

DETAILED DESCRIPTION

Figures 1, 3, 8:
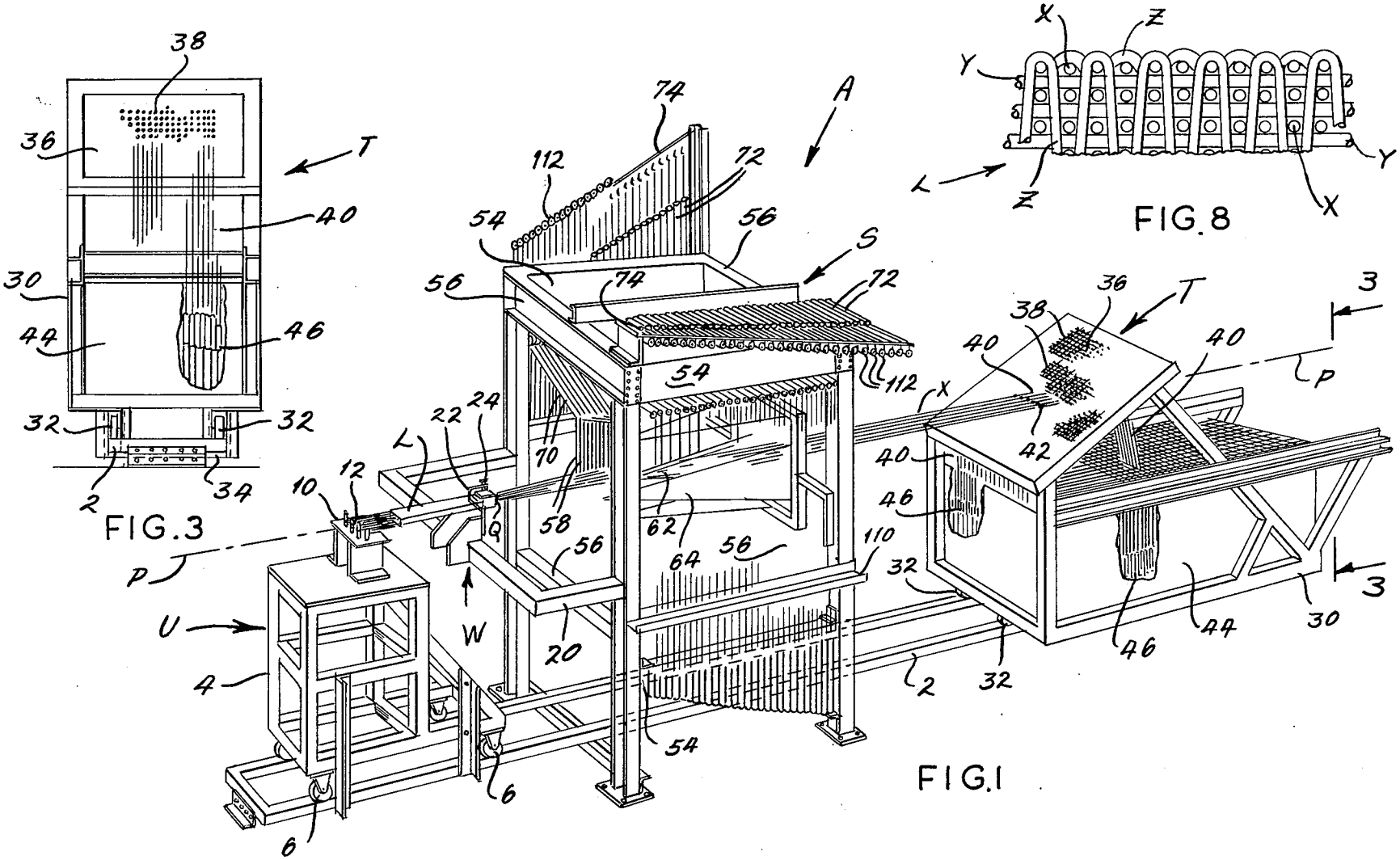
FIG. 1 is a pespective view of a weaving machine constructed in accordance with and embodying the present invention.
FIG. 3 is an end view of the tensioning assembly for the weaving machine taken along line 3—3 of FIG. 1.
FIG. 8 is a fragmentary cross sectional view of a typical weave formed on the machine.

Referring now to the drawings, A designates a loom or weaving machine (FIG. 1) which includes four basic assemblies, namely, a shedding assembly S, a tensioning assembly T, a take-up assembly U, and a weave guide W. The tensioning assembly T and the take-up assembly U are both mounted on a track 2 which extends beneath the shedding assembly S. The track 2 is elevated slightly above the surface or floor on which it is supported. As a result, both the tensioning assembly T and the take-up assembly U are capable of moving toward and away from the shedding assembly S on the track 2. The shedding assembly S is anchored firmly to the floor and hence is in a fixed position with respect to the track 2. The weave guide W is located between the shedding assembly S and the take-up assembly U and is fixed in position with respect to the shedding assembly S.

The weaving machine A produces a three dimensional orthagonal weave L (FIG. 8) from strands X, Y and Z of yarn or other suitable material. Being an orthagonal weave, its strands X, Y and Z cross each other at substantially right angles. More specifically, the strands X extended generally horizontally and parallel to the track 2. The strands Y also extend horizontally, but are oriented crosswise of the track and hence cross the strands X at 90° angles. The strands Z are likewise crosswise with respect to the longitudinal strands X, but extend vertically and hence are located at 90° angles with respect to the strands Y as well as the strands X.

During the weaving operation on the machine A (FIG. 1) the strands X extend from the take-up assembly U to the tensioning assembly T and in so doing pass through the weave guide W and the shedding assembly S. The take-up assembly U anchors the weave L which is formed by the machine A, while the tensioning assembly T applies tension to the strands X which lead into the weave W. It further aligns the strands X in a rectalinear array. While only a few strands X are shown along each side of this array (in the Y and Z directions) the tensioning assembly T is capable of handling many more strands in both directions.

Figure 10:
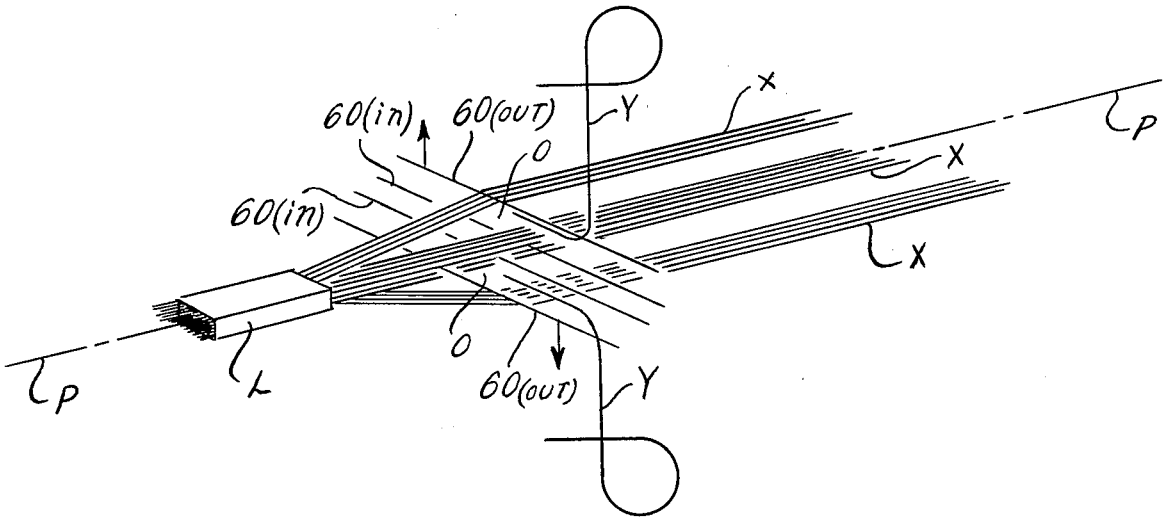
FIG. 10 is a schematic view showing cross strands being passed through shed of openings in the longitudinal strands.

The shedding assembly S increases the spacing between adjacent strands X rearwardly from the completed weave L so that a shuttle (not shown) containing a strand Y or strand Z may be passed through the space which is called a shed opening 0 (FIG. 10). Actually, two shed openings O are developed at any one time and they are symmetrical about the longitudinal centerline P of the array of strands X. The strands Y or Z which are passed through the shed openings are thereafter packed against the completed weave so as to extend the weave still further.

The take-up assembly U includes (FIGS. 2 & 4) a frame 4 having supporting wheels 6 at its bottom, and these wheels ride on the track 2. The frame 4 at its sides extends downwardly below the track 2 where it is provided with retaining rollers 8 which are located opposite the underside of the track 2 to prevent the take-up assembly U from lifting off of the track 2. The upper end of the frame 4 is located at about the centerline P for the array of longitudnal strands X. Indeed, the upper end of the frame 4 has an anchor plate 10 mounted firmly on it and this plate is provided with a plurality of upstanding pegs 12 to which the forward ends of the longitudinal strands X are attached. The frame 4 is further provided with an indexing device for moving it in very small increments away from the weave guide W and shedding assembly S. These increments should roughly correspond to the thickness of the strands Y or Z which may be as small as 0.010 inch in diameter.

The weave guide W is mounted in a fixed position with respect to the shedding assembly S and includes (FIGS. 1, 2 & 4) a frame 20 and an upwardly opening retaining trough 22 mounted on the frame 20. The cross-sectional configuration of the trough 22 matches that of the weave L so that the weave L is confined on its sides and at its bottom by the trough 22. That end of the trough 22 which is presented toward the shedding assembly S is open and defines a plane which is perpendicular to the centerline P of the array of strands X. That plane Q is at the last strand Y or Z which is woven into the weave L and hence constitutes the weaving plane of the machine A. The weave guide W further includes a clamp 24 which bears against the weave L and clamps it in a fixed position within the trough 22 so that it cannot move in the direction of the longitudinal strands X.

The tensioning apparatus T includes (FIG. 1 – 4) a frame 30 having supporting wheels 32 at its bottom and those wheels ride on the track 2. The frame 30 has members which project downwardly past the sides of the track 2 and the members carry retaining rollers 34 which are located opposite the underside of the rails of the tracks 2 to prevent the frame 30 from lifting off of the track 2. The frame 30 supports a thread guide plate 36 which is positioned at an oblique angle with respect to the centerline P, the angle being such that the upwardly presented surface of the plate 36 is presented toward the shedding assembly S. The plate 36 contains a multitude of holes 38 arranged in a rectilinear pattern. In other words, the holes 38 form parallel rows in the lateral direction as well as in the longitudinal direction. Each hole 38 has a tensioning string 40 passing through it, and this string 40 is prevented from pulling through the hole 38 by a stop bead 42 which is clamped on it. The stop bead 42 is of course larger than the hole 30. The lower ends of the strings 40 have weights 44 attached to them, and these weights are confined within a cage 46 which resembles a honeycomb in cross-section. Each weight 46 is disposed within a separate cavity of the honeycomb cage 46, and this prevents the depending weights 46 from interferring with each other and the strings 40 from becoming tangled.

The longitudinal strands X are attached to the stop beads 42 at the ends of the tensioning strings 40 such that the beads 42 are slightly away from the front face of the plate 36. This enables the weights 46 to exert force on the strands X so as to maintain the strands taut. Inasmuch as the holes 38 are arranged in a predetermined pattern, the strands X extending away from the plate 36 assume that pattern. In particular, the strands X, although they converge slightly toward weave guide W are in horizontal and vertical rows which are symmetrical about the centerline P of the array.

Like the take up assembly U, the tensioning assembly T is provided with a driving mechanism which advances it incrementally with the incremental advances being on the order of the thickness for the strands X or Y.

The shredding assembly S, which is located between the weave guide W and the tensioning assembly T, includes (FIGS. 1, 2 & 4) a large frame 50 which is mounted firmly on the floor. The frame 50 has four upright legs 52, with the legs on each side being connected by upper and lower longitudinal members 54 which extend generally parallel to the array of longitudinal strands X. The forward legs 52 are connected by upper and lower cross members 56 and likewise so are the rear legs 52, thus forming front and rear windows on the frame 50. The array of longitudinal strands X passes through these windows, being generally centered with respect to them.

Figure 5:
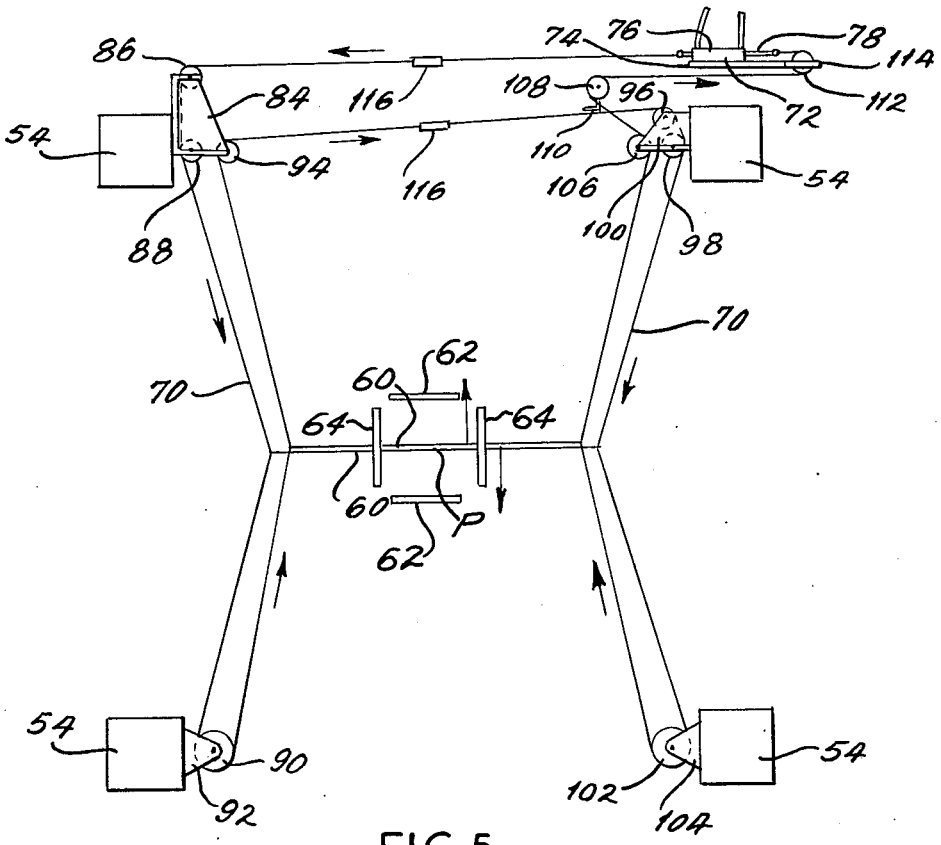
FIG. 5 is a front elevational view taken along line 5—5 of FIG. 2 and showing the cable system for the first pair of horizontal positioning wires in the shedding assembly, the positioning wires being in their inner positions.
Figure 6:
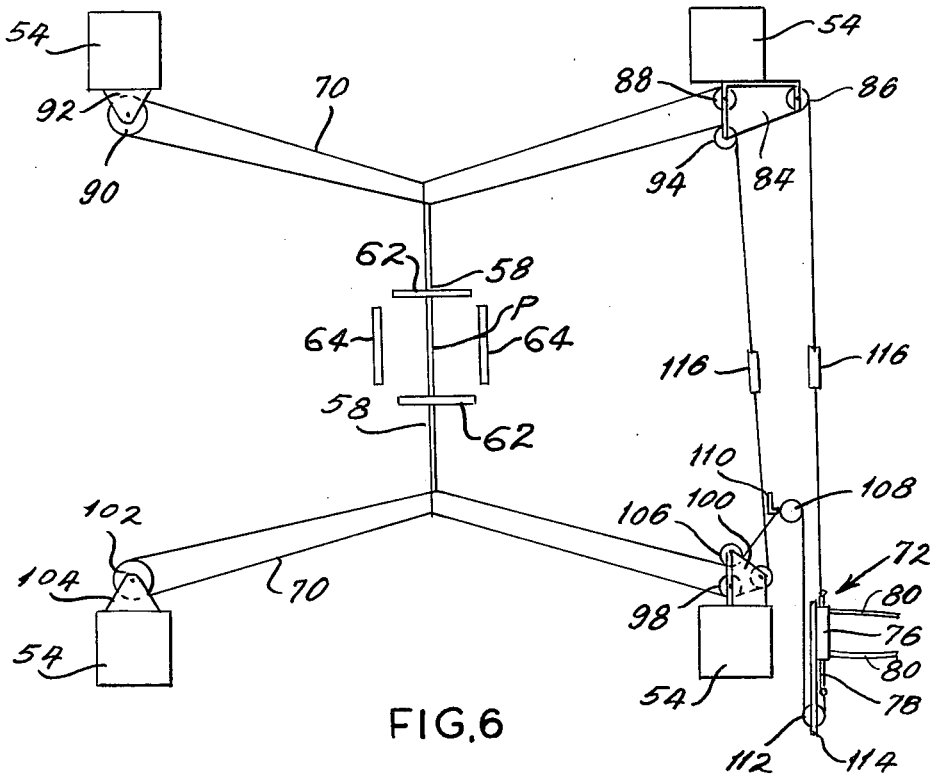
FIG. 6 is a front elevational view taken along line 6—6 of FIG. 2 and showing the cable system for the first pair of vertical positioning wires in the shedding assembly.
Figure 7:
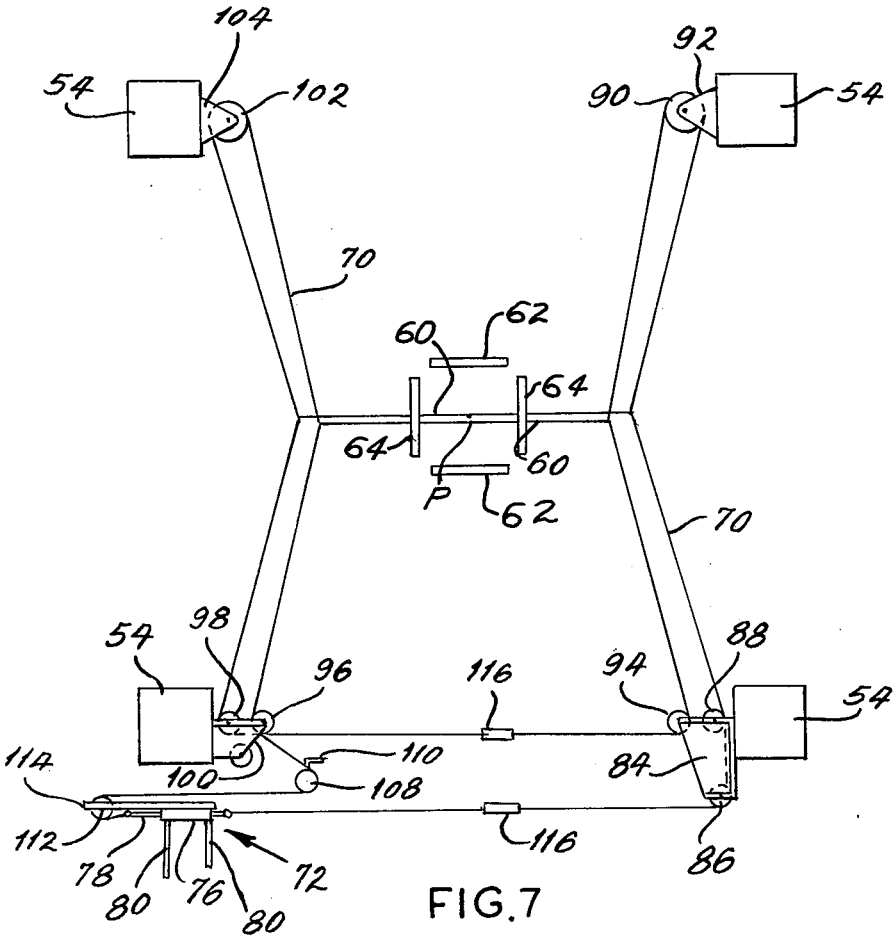
FIG. 7 is a front elevational view taken along line 7—7 of FIG. 2 and showing the cable system for the second pair of horizontal positioning wires.

The space between the two forward legs 52 and the two rear legs 52 is occupied by a plurality of vertical positioning wires 58 (FIG. 6) and a plurality of horizontal guide wires 60 (FIGS. 5 & 7). The wires 58 and 60 pass between adjacent strands X so that when a horizontal wire 58 is moved away from the centerline, it moves the strands X located outwardly from it and thereby creates a horizontal shed openings O (FIG. 10). Similarly, when a vertical wire 60 is moved away from the centerline P, it moves all the strands X located beyond it to create a vertical shed opening O. The vertical wires 58 are arranged in pairs with the wires 58 of each pair being located on opposite sides of the centerline P and spaced equally therefrom. Likewise, the horizontal wires 60 are arranged in pairs. With respect to each pair of horizontal wires 60 one is located above the centerline P while the other is located an equal distance below the centerline P. The inner positions of all but the few forwardmost vertical wires 58 are determined by a pair of positioning members 62 (FIGS. 1 and 4) spaced equally above and below the longitudinal centerline P. The members 62 have side surfaces which forwardly converge and the vertical wires 58 bear against these side surfaces. Thus, the vertical wires 58 at the front of the frame 50 are closer to the centerline P than the vertical wires 58 at the rear of the frame. Similarly, the inner positions of all but the few forwardmost horizontal wires 60 are determined by another pair of positioning members 64 (FIGS. 1 and 2) which are spaced equal distances from the centerline P on each side of it and likewise have cconverging surfaces against which the horizontal wires 60 bear when in their inner positions. Thus, the horizontal wires 60 at the front of the frame 50 are located closer to the centerline P than those at the rear of the frame 50. From the forwardmost pair of vertical wires 58*a* each successive pair 58*b*, *c*, *d*, etc., is spaced slightly further outwardly from the longitudinal centerline P, and the same is true of successive pairs of horizontal wires 60*a*, *b*, *c*, *d*, etc.,. Moreover, the pairs of vertical and horizontal wires 58 and 60 alternate from the front to the rear of the frame 50. In other words, there is a pair of horizontal wires 60, next a pair of vertical wires 58, then another pair of horizontal wires 60, thereafter another pair of vertical wires 58, etc. In total there may be 100 pairs of vertical wires 58 and 100 pairs of horizontal wires 60, a total of 200 individual wires. Only a few wires 58 and 60 are illustrated in the drawings.

Each pair of wires 58 or 60 is supported entirely on a single cable 70 (FIGS. 5 – 7). The cable 70 is moved between inner and outer positions by a linear actuator 72, which is preferably an air cylinder. In the inner position the wires 58 or 60 of most pairs bear against their respective positioning members 62 and 64. In the outer positions, the wires 58 or 60 are spaced outwardly from their respective positioning members 62 or 64. The cable 70 and actuator 72 form a cable system.

Since all of the cables 70 and actuators 72 are substantially the same, only the cable 70 for the forwardmost pair of horizontal wires 60 will be described in detail.

The linear actuator 72 for the forwardmost cable 70 (FIG. 5) is secured to a mounting plate 74 which in turn is attached to the frame 50 at the upper right hand corner thereof when viewed from the take-up assembly U. The plate 74 is in a horizontal disposition and extends almost the entire length of the frame 50, overlying the member 54 at the upper right hand corner of the frame 50. The actuator 72 is a double acting air cylinder which includes a barrel 76 and a piston rod 78 extended through the barrel 76. Of course, the piston rod 78 carries a piston which is within the barrel 76 where it wipes the interior surface thereof. The barrel 76 has a port 80 at each end. Thus, when pressurized air is admitted to one end, the piston will be forced away from that end and will move the rod 78 with it. Likewise, when air is admitted to the port 80 at the opposite end, the piston rod 78 will move in the opposite direction. The piston rod 78 projects beyond both ends of the barrel 76 where its ends are connected to the ends of the cable 70 by clevises. In this regard, the cable 70 makes a complete loop along three sides of the frame 50, starting at one end of the piston rod 78 and terminating at the opposite end of the rod 78. Along each of the three sides, the cable 70 has inner and outer passes.

Starting at the inside end of the piston rod 78 (FIG. 5), that is the end located closest to the center of the frame 50, the cable 70 extends to a triangular pulley bracket 84 having pulleys 86 and 88 at the two outer corners thereof. The bracket 84 is mounted against the right side of the longitudinal member 54 at the upper left hand corner of the frame 50. The cable 70 extends over the uppermost pulley 86 where it turns 90° and then passes over the pulley 88 which is located directly below the pulley 86. Beyond the pulley 88, the cable 70 extends downwardly and slightly inwardly, and near the horizontal center plane of the frame 50 (the horizontal plane passing through the longitudinal centerline P) the lower of the horizontal guide wires 60 is attached to the cable 70. Thereupon the cable 70 is directed outwardly to a single corner pulley 90 which is mounted on a bracket 92 attached to the longitudinal member 54 at the lower left hand corner of the frame 50. After passing around the pulley 90, the cable 70 turns inwardly and generally parallels the portion leading to the pulley 90. Near the horizontal plane of the frame 50, it is attached to the left end of the upper horizontal guide wires 60, beyond which it extends upwardly and outwardly to a pulley 94 at the lower corner of the triangular pulley bracket 84. Thus, along the left side of the frame 50, the cable 70 is arranged in outer and inner passes, both of which are drawn inwardly, that is, to the right by the horizontal wires 60.

The cable 70 passes around the pulley 94 (FIG. 5) and extends horizontally to the longitudinal member 54 at the upper right hand corner of the frame 50. Here the cable 70 passes around a pair of pulleys 96 and 98 on a bracket 100 which projects generally inwardly with respect to the frame 50 in contrast to the bracket 84 which projects generally outwardly. Beyond the pulley 98, the cable 70 extends downwardly and sightly inwardly to the right end of the lower guide wire 68 to which it is attached. The cable 70 is in effect drawn inwardly by the lower wire 60 so beyond the wire 58 the cable 70 extends downwardly and outwardly toward the longitudinal member 54 at the lower right hand corner of the frame 50. Here the cable 70 passes around a pulley 102 which rotates on a bracket 104 attached to the longitudinal member 54. After leaving the pulley 102 the cable 70 extends upwardly and slightly inwardly and is attached to the upper horizontal wire 60, from which it extends further upwardly and slightly outwardly since the wire 60 distorts this portion of the cable 70 inwardly. The cable 70 leads to the pulley bracket 92 at the upper right corner of the frame 50 where it is trained around a pulley 106 on the bracket 92. Thus, along the right portion of the frame 50, the cable 70 is likewise arranged in two passes, both of which are drawn inwardly, that is to the left by the horizontal wires 60.

From the pulley 106, the cable 70 is directed to the left toward a pulley 108 (FIG. 5) located on a longitudinal pulley mount 110 which extends between the upper cross members 56 somewhat to the left of the longitudinal member 54 to which the plate 74 is secured. At the pulley 108, the cable 70 turns outwardly and passes alongside the actuator 72 generally parallel to the piston rod 78 thereof. Beyond the outer end of the piston rod 78, the cable 70 passes around a pulley 112 mounted on a bracket 114 attached to the mounting plate 74. At the pulley 112, the cable 70 turns inwardly and its end is connected to the outer end of the piston rod 78. The two horizontal portions of the cable 70 along the upper portion of the frame 50 are provided with turnbuckles 116 which maintain the entire cable 70 taut.

When the piston rod 78 is at its right hand position with respect to the barrel 76 (FIG. 5), the two horizontal wires 60 are in their inner positions, which in the case of forwardmost cables 70 means the wires 60 are almost completely together. In this regard, the forward ends of the positioning members 64 are slightly to the rear of the forwardmost wires 60 and the members 64 do not affect the positions of those wires.

Figure 5A:
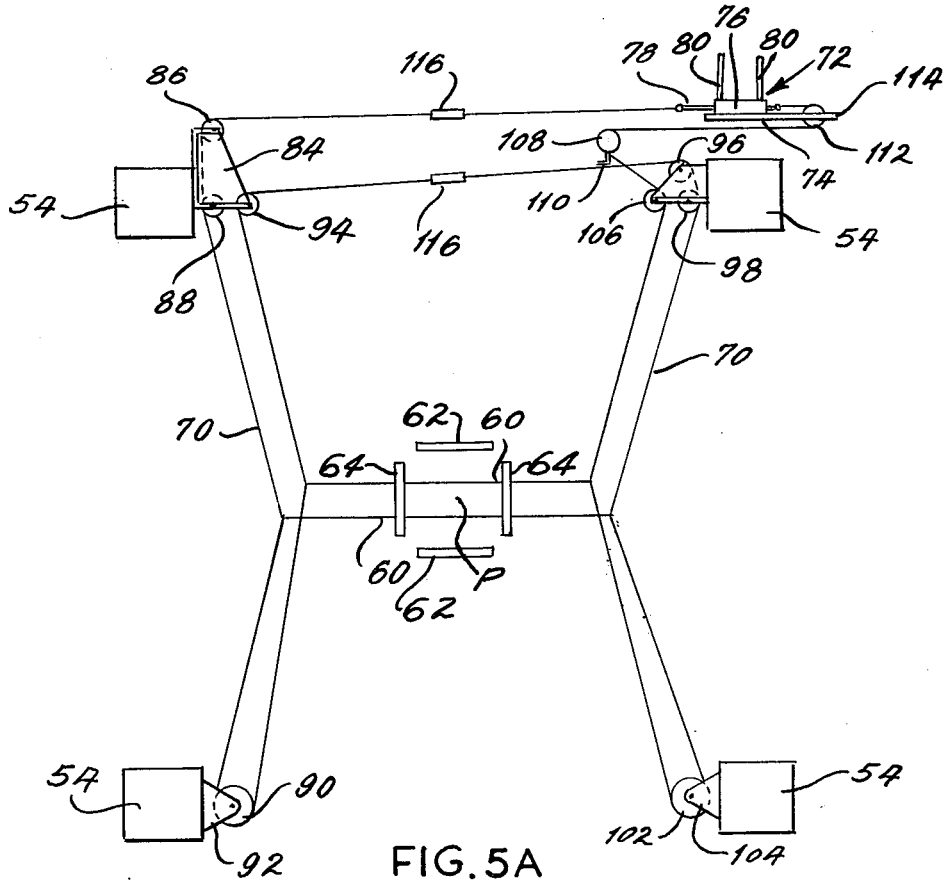
FIG. 5A is a view similar to FIG. 5, but showing the positioning wires in their outer positions.

Now when the piston rod 78 moves to the left (FIG. 5A) the entire cable 70 shifts, its two inner passes moving upwardly and its two outer passes moving downwardly. Since the lower positioning wire 60 is attached to the outer passes, it also moves downwardly. The upper positioning wire 60, being attached to the inner passes, moves upwardly with those inner passes. Consequently, when the piston rod 78 moves to the left, the horizontal wires 60 spread apart. Conversely, when the piston rod 78 moves to the right the horizontal wires 60 move together.

The cable system for the next set of horizontal wires 60 is in effect rotated 180° from the previously described system (FIG. 7). In other words, its linear actuator 72 is positioned on the longitudinal member 54 at the lower left hand corner of the frame 50, while its pulleys 90 and 102 are at the upper part of the frame 50. Thus, the two positioning wires 60 controlled by this system spread apart when the piston rod 78 of the linear actuator 72 therefor moves to the right.

As previously noted, the pairs of vertical guide wires 58 and horizontal guide wires 60 alternate from the front to the rear of the frame 50 so that following the first pair of horizontal guide wires 60 is a pair of vertical guide wires 58, another pair of horizontal guide wires 60, and then another pair of vertical guide wires 58, etc. The vertical wires 58 are likewise actuated by cable systems which are identical to the cable systems of the vertical wires 58, except that those cable systems are rotated 90° with respect to the cable systems for the horizontal wires 60. More specifically, the cable system for the pair of vertical wires 58 (FIG. 6) which follows the first pair of horizontal wires 60 has its liner actuator 72 mounted on the longitudinal member 54 at the lower right hand corner of the frame 50 and its pulleys 90 and 102 on the longitudinal members 54 at the left side of the frame 50 so that when the piston rod 78 moves upwardly the vertical wires 58 controlled by the system spread apart. On the other hand, the cable system for the pair of vertical wires 58 which follow the second pair of horizontal wires 60 is rotated 180° and has its linear actuator 72 at the upper left hand corner of the frame 50. Thus, from the front to the rear of the frame 50, each cable system is rotated 90° from its predecessor. Accordingly, the linear actuators 72 are located along all four of the longitudinal members 54, and the linear actuators 72 along a given longitudinal member 54 control every fourth pair of guide wires 58 or 60, whatever the case may be.

Figures 2, 4:
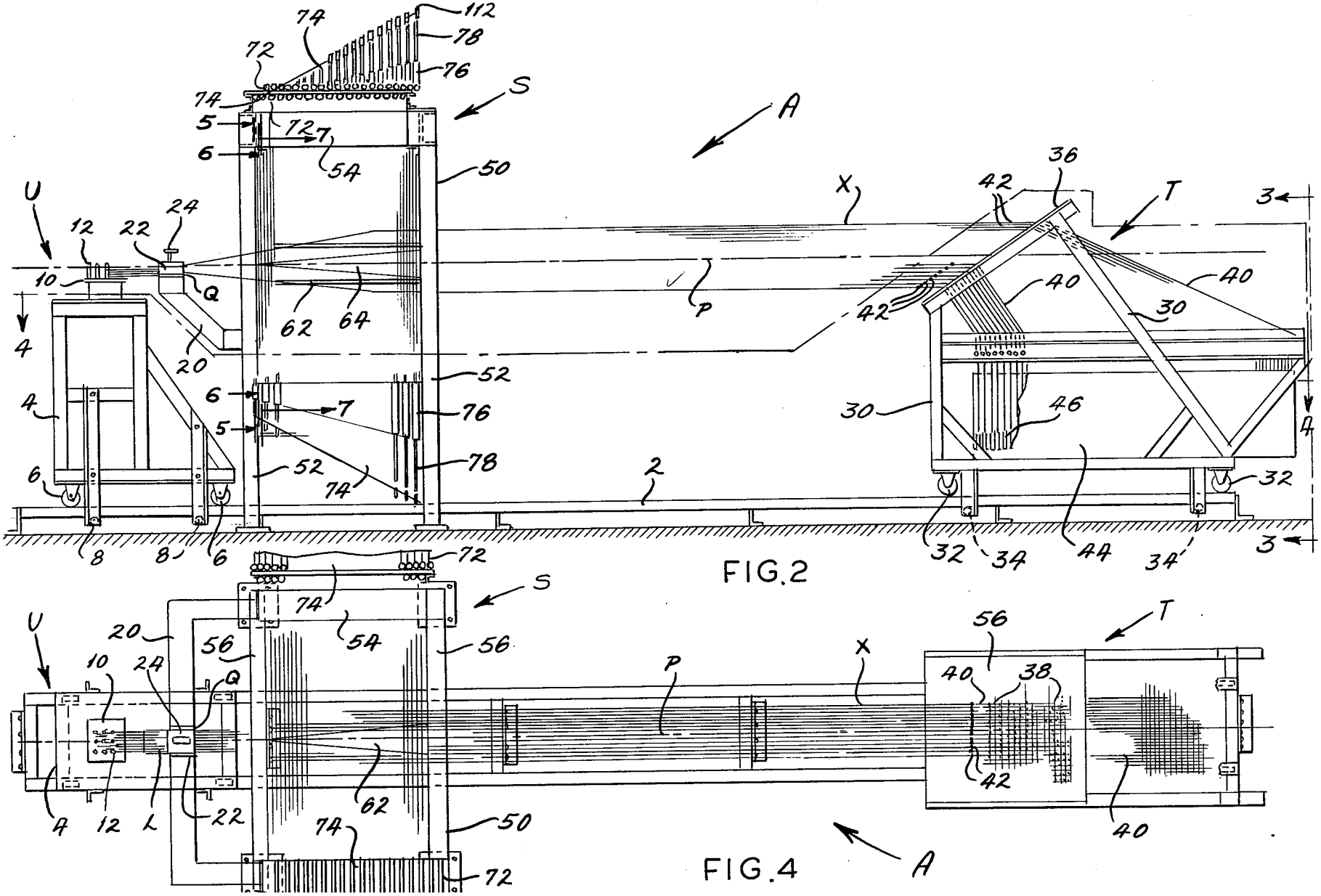
FIG. 2 is a side elevational view of the weaving machine.
FIG. 4 is a top plan view of the weaving machine.

All of the linear actuators 72 along any longitudinal member 54 are attached to the mounting plate 74 and since the barrels 76 of the cylinders occupy considerably more space in the lateral direction than the cables 70 and wires 58 or 60, successive actuators 72 are located against opposite surfaces of the plate 74 (FIGS. 2 & 4). For example, with reference to the cable system for the first pair of horizontal guide wires 60*a*, the linear actuator 72 is located against the upper surface of the plate 74, while the next linear actuator 72 is against the bottom surface of the plate 74. That actuator controls the pair of horizontal wires 60*c* twice removed from the pair controlled by the first actuator 72. Thus successive actuators 72 on any plate 74 alternate from one side to the other. This enables the shedding assembly S to assume a highly compact configuration. From the front to the rear of each mounting plate 74, the linear actuators 72 become progressively longer (FIGS. 1 & 2) so that the piston rods 78 have progressively longer strokes. As a result, the wires 58 and 60 at the rear of the frame 50 move considerably further between their inner and outer positions than do the wires 58 and 60 at the front of the frame 50.

Each actuator 72 has two air lines (FIGS. 5–7) leading to it, with one being connected to the port 80 at one end and the other to the port 80 at the other end. These air lines originate at electrically operated valves (not shown), there being a separate valve for each actuator 72. The valves are in turn connected to a supply of pressurized air. The valves may be controlled by manually operated switches, or preferably by a computer which is programmed to produce a desired weave L.

THREADING THE MACHINE

The shedding assembly S controls the positions of the longitudinal strands X, so entire rows of strands X may be moved to produce horizontal and vertical shed openings O. This enables the strands Y and Z to be easily passed between adjacent strands X to produce the desired weave W (FIG. 10). However, the strands X must be properly located with respect to the various vertical and horizontal guide wires 58 and 60 in order for the shedding assembly S to function. In most weaves L this positioning involves placing a vertical row of strands X between each adjacent pair of vertical wires 58 and a horizontal row of strands X between each adjacent pair of horizontal wires 60.

Figure 9:
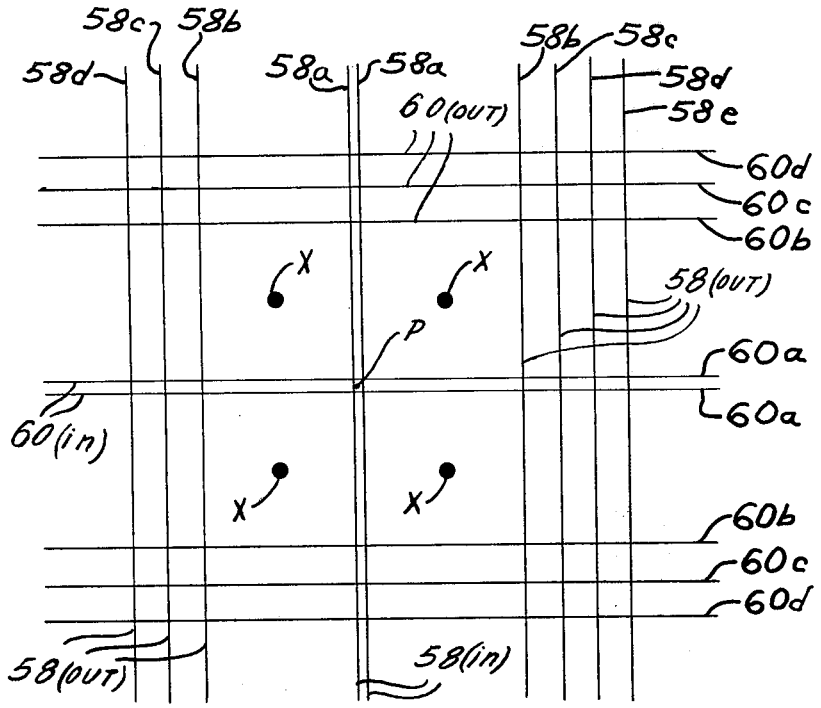
FIG. 9 is a fragmentary end view of the shedding assembly showing the positioning of the various horizontal and vertical positioning wires as the machine is threaded with the first group of four longitudinal strands.

To thread the machine in this manner, all but the first pair of vertical positioning wires 58*a* and the first pair of horizontal positioning wires 60*a* are moved to their outer positions creating four enlarged squares arranged symmetrically about the center axis P (FIG. 9). Four longitudinal strands X, are attached to the four centermost tensioning strings 40 of the tensioning assembly T and are extended longitudinally therefrom through the enlarged squares in the shedding assembly S, with one strand X, being in each square. The front ends of the strand X are tied to the pegs 12 on the take-up assembly U such that the tensioning strings 40 are drawn slightly out of the guide plate 36, thus enabling the weight 46 to act against the strings 40 and maintain the strands X taut.

Figure 9A:
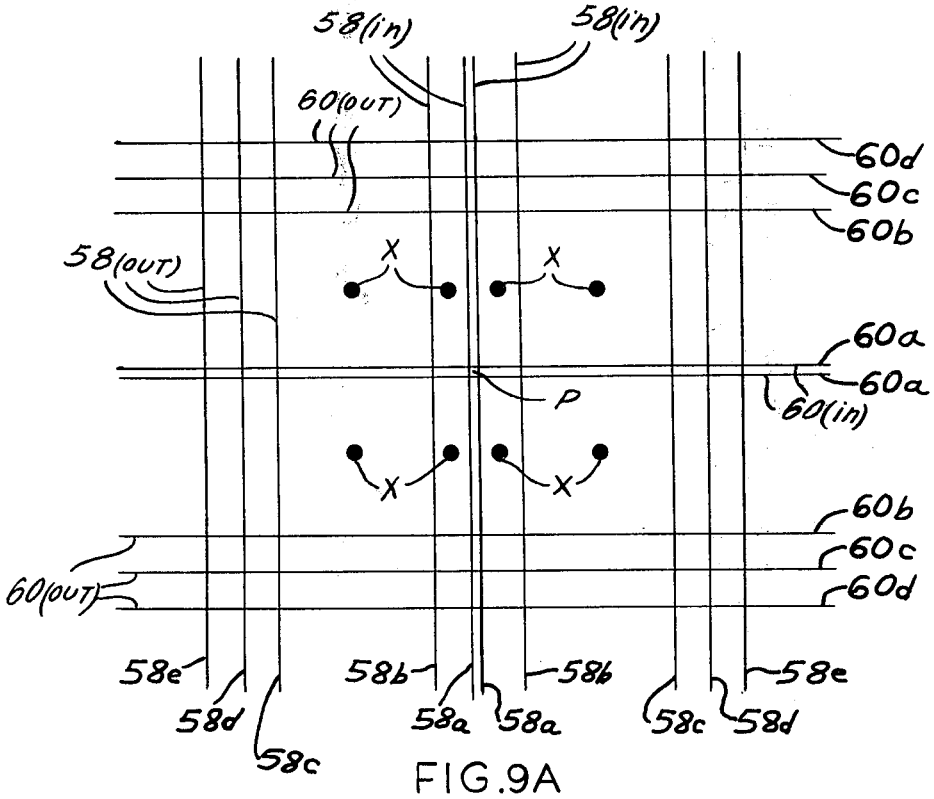
FIG. 9A is a view similar to FIG. 9 but showing the machine as the second group of four longitudinal strands are threaded.

After the four initial strands X are threaded through the shedding assembly S, the actuator 72 which controls the cable system for the second set of vertical wires 58*b* is energized to move those wires inwardly, thus creating four enlarged squares, with each square being bounded by the second and third vertical wires 58*b, c* and the first and second horizontal wires 60*a, b* (FIG. 9A). More longitudinal strands X are threaded through the squares, they being attached to the strings 40 located directly outwardly from the strings 40 to which the first four strands X were attached so as to maintain the same array pattern within the shedding mechanism S as at the guide plate 36.

Next, the third vertical wires 58*c* are moved to their inner positions, thus creating enlarged squares between the third and fourth vertical wires 58*c, d* on each side of the longitudinal centerline P. The procedure continues until two horizontal rows containing the desired number of longitudinal strands X exist along the first pair of horizontal wires 60*a*.

Figure 9B:
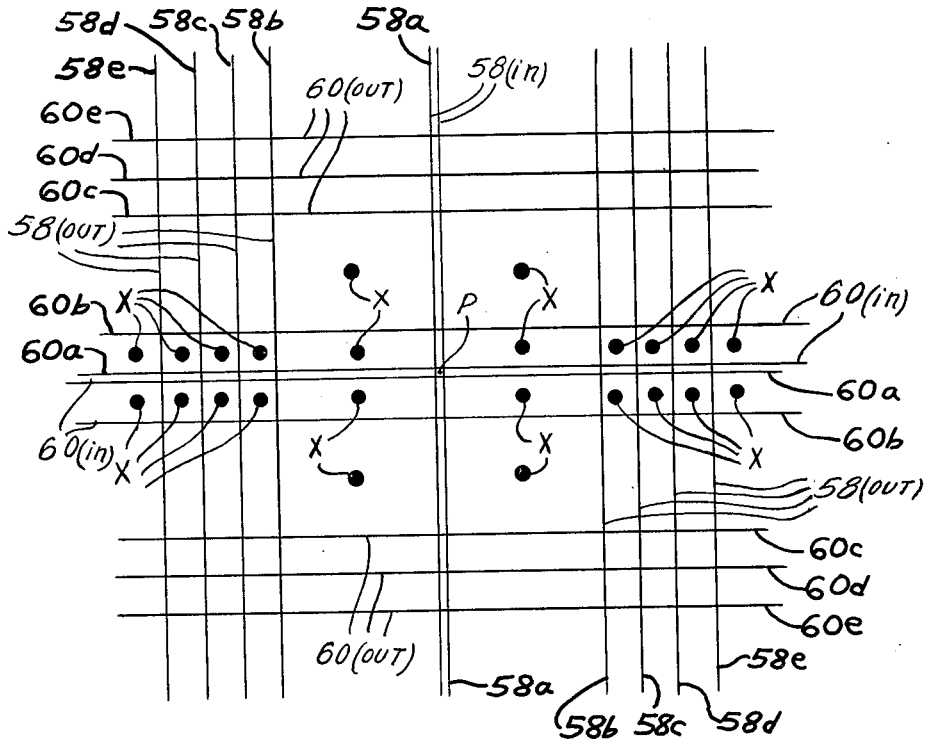
FIG. 9B is a view similar to FIG. 9, but showing the machine as the first group of four longitudinal strands are threaded in the second horizontal row of longitudinal strands.

Upon completion of the threading of the two initial rows, all of the vertical wires 58 except the wires 58*a* of the first pair are returned to their outer positions, this being achieved by energizing the linear actuators 72. Then the second horizontal wires 60*b* on each side of the centerline P are moved to their inner positions and two more horizontal rows of strands X are threaded in the manner previously described, these rows being between the second and third horizontal wires 60*b, c* (FIG. 9B).

Successive horizontal rows of strands X are threaded in the foregoing manner until the array of strands X so formed possesses the desired number of longitudinal strands X in the horizontal and vertical directions.

OPERATION

The shedding assembly S creates the shed openings O (FIG. 10) in the array of longitudinal threads X, and wherever a shed opening O exists a strand Y or Z may be passed through the array of longitudinal threads X to create the weave L. More specifically, if it is desired to pass a strand Y horizontally through the array of strands X, the linear actuators 72 for the all of those horizontal wires 60 located outwardly from the selected location for the horizontal thread Y are energized, thus creating a pair of shed openings O at the selected locations, one shed opening O being above the centerline P and the other below the centerline P. The strand Y is passed through the shed opening O, and then a packing blade is inserted beyond that strand and pushed up to the packing plane O defined by the rear edge of the trough 22 in the weave guide W. This packs the strands Y tightly against that much of the weave L which is already completed.

To create a vertical shed opening O at a desired location in the array of longitudinal threads X, all the vertical wires 58 outwardly from that location are energized to bring the longitudinal strands X controlled thereby outwardly. The vertical strand Z is passed through the shed opening O. The vertical strand Z is likewise packed into place by running a packing blade through the shed opening O. Actually, two vertical shed openings are created contemporaneously, so that two strands 2 may be passed through the longitudinal strands X after each change in the positioning of the wires 58.

The order in which various vertical and horizontal wires 58 and 60 are moved determines the weave pattern and a wide variety of weave patterns are available.

The horizontal strands Y and the vertical strands Z may be passed through the shed openings O in the array of longitudinal strands X by hand or by suitable machine designed for that purpose and controlled by the computer. In this regard, the strands Y and Z may be contained in shuttles and pay out of the shuttles as they pass through the shed openings O.

After each horizontal strand Y or vertical strand Z is packed into the existing portion of the weave L, the take-up assembly U moves away from the frame 50 by an amount generally equalling the thickness of the strands Y or Z so that the end of the weave L will always be at packing plane Q of the weave guide W, that is, at the plane defined by the rear end of the trough 22.

MODIFICATION

Figures 11, 12:
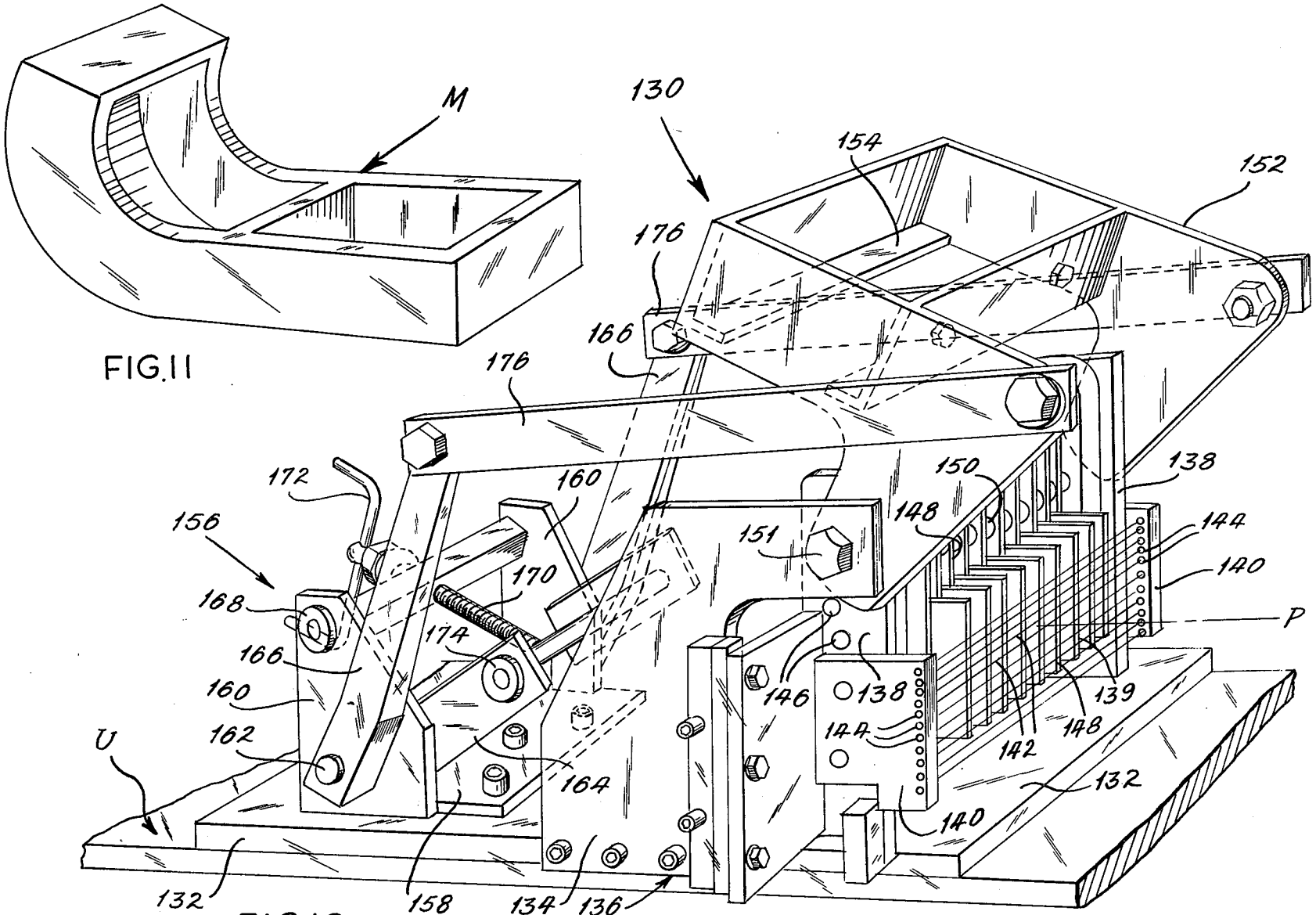
FIG. 11 is a perspective view of a contoured weave which may be formed on the weaving machine of the present invention.
FIG. 12 is a perspective view of a shaping device which is installed on the take-up assembly of the weaving mchine for forming the contoured weave of FIG. 11.
Figure 13:
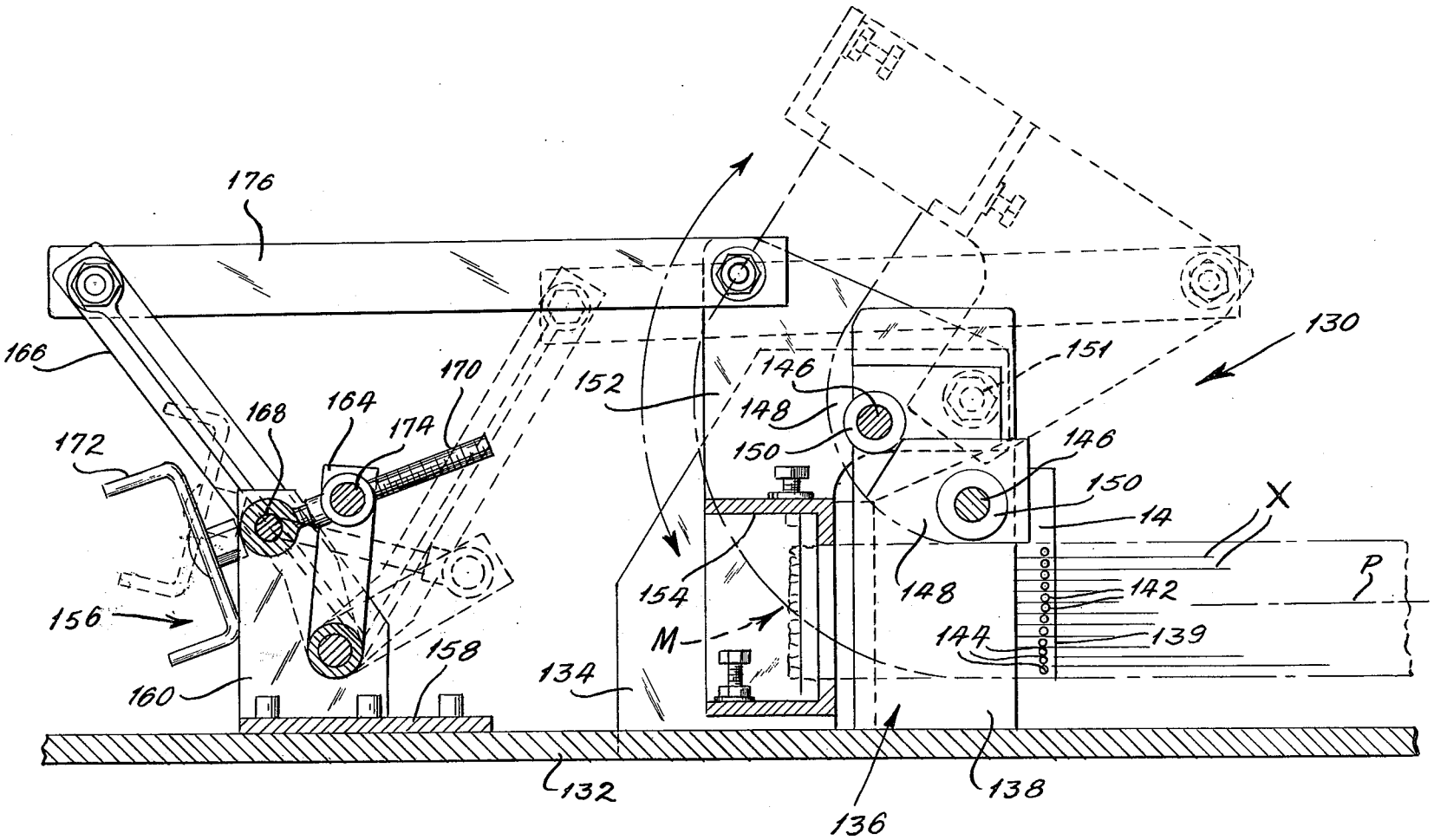
FIG. 13 is a longitudinal sectional view of the shaping device.

When the take-up assembly U is provided with the fixed anchor plate 10 and upstanding pegs 12 for securing the front ends of the longitudinal strands X, the machine A only has the capability of forming a straight weave L, that is a weave which is parallel to the centerline P of the array of longitudinal strands X. However, when a shaping apparatus 130 (FIGS. 12 & 13) is installed on the frame 4 of the take-up assembly U, the machine A may be used to form a contoured weave M, that is a weave having an arcuate segment (FIG. 11).

The shaping device 130 includes a base plate 132 which is attached firmly to the upper end of the frame 4 for the take-up assembly U. Bolted to the base plate 132 are a pair of side plates 134 which project upwardly from the base plate 132 and are parallel to the longitudinal centerline P of the array. At their upper ends the side plates 134 turn rearwardly toward the shedding mechanism S. The side plates 134 in turn carry a weave positioner 136.

The weave positioner 136 includes a pair of vertical plates 138 which are set inwardly from, yet are parallel to, the side plates 134 so as to form a gate 139 through which the completed portion of the weave M enters the shaping device 130. The vertical plates 138 carry guide members 140 in which the ends of horizontal guide wires 142 are confined. The guide wires 142 span the gate 139 and pass between the various horizontal rows of longitudinal strands X so as to properly position those strands as they enter shaping device 130. The two vertical plates 138 have apertures 144 which receive the ends of mounting pins 146. The pins 146 extend between the two plates 138 and serve as mounts for weave positioning elements 148 which are separated by spacers 150. Each positioning element 148 has at least two pins 146 extended through it and its downwardly and rearwardly presented edge possess an arcuate configuration which is the same as the inner contour for the weave M. The weave M bears against these edges as it is advanced through the shaping device 130 so that the weave M maintains the desired shape as the weaving operation progresses.

The rearwardly projecting portions of the two side plates 134 have separate but sligned bolts 151 extended through them, and these bolts serve as journals for a weave attachment 152 having a connecting portion 154. The longitudinal strands X are attached to the connecting portion 154. The weave attachment 152 is located between the two side walls 134 and pivots from an initial position, wherein the connecting portion 154 is located directly behind the gate 139, to an elevated position located generally above the weave positioning element 148. As the weave attachment 152 moves, its connecting position 154 follows the arcuate edges on the positioning element 148.

The weave attachment 152 is moved between its initial and elevated positions by an actuating assembly 156 including a base 158 which is mounted on the frame 4 of the take-up assembly U ahead of the base plate 132 and the side plate 134. The base 158 has a pair of upstanding plates 160 in which an axle shaft 162 rotates, and the axle shaft 162 has pairs of inner and outer arms 164 and 166 attached firmly to it. These arms 164 and 166 are disposed at different angles so that the combination of the shaft 162 and the arms 164 and 166 creates a bell crank which rotates on the base 158.

The two upstanding plates 160 on the base 158 at their upper ends have a rotatable shaft 168 extended between them, and this shaft 168 carries a screw 170 which runs perpendicular thereto. The screw 170 is free to rotate within the shaft 168, but is confined in the axial direction. It has a crank arm or handle 172 at its rear end, while its forward end is threaded through a cross shaft 174 which is interposed between the upper ends of the two inner arms 164 forming part of the bell crank. The cross shaft 174 is capable of rotating with respect to the inner arms 164. The outer arms 166 of the bell crank are somewhat longer than the inner arms 164 and at their upper ends are connected to the upper end of the pivotal weave attachment 152 by connecting links 176. Thus, when the screw 170 is turned inwardly the weave attachment 152 swings upwardly and vice-versa.

Initially the screw 170 is backed off to its fullest extent so that the weave attachment 152 is in its lower or initial position. In that position, the connecting portion 154 is located directly behind the gate 139 of the weave positioner 136. Also at the outset, only one set of weave positioning elements 148 is utilized, that set being located directly above the gate 139. The longitudinal strands X, after being threaded through shedding mechanism S as previously explained, are passed between the guide wires 142 of the weave positioner 136 and at their forward ends are attached to the connecting portion 154 of the weave attachment 152 so that the array receives the desired configuration.

Once the longitudinal strands X are attached in the proper position, the weaving operation commences with the shedding mchanism S operating in the manner previously discussed. As the weave grows the screw 170 is turned, and this causes the weave attachment 152 to pivot about the bolts 151 and in so doing its connecting portion 154 moves forwardly away from the gate 139 and also begins to turn upwardly, thus drawing the completed portion of the weave M through the gate 139. The screw 170 is turned incrementally, there being a slight turn with each additional cross strand Y or Z which is laid into the array of longitudinal strands X. The weave M turns upwardly with its inner surface being against and shaped by the curved lower edges of the weave positioning elements 148. When the weave M approaches the end of one set of weave positioning elements 148, another set of elements 148 is installed with more pins 146. Since the arcuate portion of the weave M has greater length on the outside of the arc than on the inside, it is necessary to weave more horizontal cross strands Y into the lower portion of the array of longitudinal strands X than into the upper portion.

Once the curved portion of the weave M has been completed, the straight portion is produced in the manner previously described. During this part of the weaving operation the screw 170 is not moved and the completed portion of the weave M is advanced by moving the take-up assembly U along the track 2 as previously discussed.

This invention is intended to cover all changes and modifications of the example of the invention herein chosen for purposes of the disclosure which do not constitute departures from the spirit and scope of the invention.

What is claimed is:

1. In a weaving machine having means for positioning a plurality of longitudinal strands in an array with the strands of the array extended generally in the same direction and located generally side by side in both crosswise directions, a shedding apparatus for moving selected strands of the array so as to create shed openings through which other strands may be extended generally through the array in two crosswise directions so as to form a three dimensional weave, said apparatus comprising: a frame, a plurality of first elongated positioning elements extended crosswise through the array between adjacent longitudinal strands thereof, the first elements being generally parallel to each other; a plurality of second elongated positioning elements extended crosswise through the array between adjacent strands thereof, the second elements being generally parallel to each other and being located at an angle with respect to the first elements; and actuating means for moving the elements between inner and outer positions so as to increase the spacing between selected adjacent strands of the array and thereby create a shed opening in the array.

2. The combintion according to claim 1 wherein first elongated elements are oriented at substantially right angles with respect to the second elongated elements.

3. The combination according to claim 1 wherein successive first and second positioning elements are arranged one behind the other in the direction of the longitudinal strands.

4. The combination according to claim 3 wherein the first and second elements are arranged alternatively so that a first element is interposed between adjacent second elements and a second element is interposed between adjacent first elements.

5. The combination according to claim 4 wherein successive first and second elements are spaced progressively further away from the longitudinal centerline of the array such that the first and second strands at one end of the frame are located closer to the longitudinal centerline than the first and second strands at the other end of the frame.

6. The combination according to claim 1 wherein the first and second positioning elements are arranged in pairs with the elements of each pair being on opposite sides of the longitudinal centerline and being moved in unison by the actuating means, either toward or away from the longitudinal centerline of the array.

7. The combination according to claim 6 wherein the actuating means comprises a separate cable for each pair of first and second elongated positioning elements, the cable being extended generally crosswise of the longitudinal array, and an actuator for moving the cable.

8. The combination according to claim 7 wherein each cable is extended crosswise with respect to the array at two locations beyond the array where it is provided with inner and outer passes which move in opposite directions with respect to each other, when the actuator is energized; and wherein one of the elongated elements of the pair carried by the cable is attached at its end to the inner passes of the cable and the other elongated elements of the pair is attached at its ends to the outer passes, whereby the elongated elements of the pair either move apart or together when the cable is moved.

9. The combination according to claim 8 wherein the actuators for the cables are arranged in banks around the frame, with the banks of actuators for the cables to which the first elongated elements are attached being offset from the banks of actuators for the cables to which the second elongated elements are attached.

10. The combination according to claim 9 wherein the actuators for the cables of the first elongated elements are arranged in two banks located 180° apart with respect to the longitudinal centerline of the array, the actuators for successive pairs first elements being located on opposite banks; and wherein the actuators for the cables of the second elongated elements are arranged in two banks located 180° apart with respect to the longitudinal centerline of the array, the actuators for successive pairs of second elements being located on opposite banks for the second actuators.

11. The combination according to claim 8 wherein each actuator is an air cylinder having a barrel to which pressurized air is admitted and a piston rod extended axially through the barrel and projected beyond each end thereof, and the one end of the cable is attached to one end of the piston rod and the other end of the cable is attached to the other end of the piston rod.

12. The combination according to claim 6 and further comprising locating members carried by the frame; and wherein at least some of the elongated elements are against and positioned by the locating members when the elongated elements of a pair are moved together.

13. In a weaving machine having means for positioning a plurality of longitudinal strands in an array with the strands of the array being extended generally in the same direction, a shedding apparatus for moving selected strands of the array so as to create a shed opening in the array through which other strands may be extended crosswise of the array so as to create a weave, said apparatus comprising: a frame; a cable supported on the frame and having two passes located beyond one side of the array of longitudinal strands and two passes located beyond the opposite side of the array; an actuator connected to the cable for moving the cable such that the two passes on each side of the array move in opposite directions; first and second wires extended between those passes on each side of the array which move in the same direction and passing through the array of longitudinal strands, whereby when the cable is moved by the actuator, the first and second wires will move either together or apart in unison, depending on the direction in which the cable is moved, and a shed opening will either being created or closed in the array of longitudinal strands.

14. The combination according to claim 13 wherein the actuator is a double acting air cylinder having a barrel which is mounted in a fixed position with respect to the frame and further having a piston rod extended through the barrel with its ends projecting beyond the barrel, one end of the piston rod being connected to one end of the cable, and the other end of the piston rod being connected to the other end of the cable.

15. The combination according to claim 13 wherein the cable is located opposite three sides of the array of longitudinal strands and the wires are extended between the portions on two sides and the actuator is connected to the portion at the third side.

16. A weaving machine comprising: a take-up assembly to which the ends of the longitudinal strands are attached; a tensioning asssembly to which the opposite ends of the longitudinal strands are attached, the tensioning assembly including means for maintaining the longitudinal strands taut and means for positioning the longitudinal strands in an array which has a plurality of longitudinal strands in both crosswise directions, and a shedding assembly located between the take-up assembly and the tensioning assembly such that the longitudinal strands pass through it, the shedding assembly having a plurality of parallel first wires which pass through the array in one crosswise direction with different first wires being located between different strands of the array and a plurality of parallel second wires which pass through the array in the crosswise direction which is oriented 90° from the direction of the first wires with different second wires also being located between different strands of the array, the shedding assembly further having means for moving the first and second wires to create shed openings in the array so that the other strands may be passed through the array of longitudinal threads to create a weave.

17. A machine according to claim 16 wherein the take-up assembly and the tensioning assembly move relative to the shedding assembly so that the longitudinal strands may be drawn through the shedding assembly as the weave becomes progressively larger.

18. A machine according to claim 16 and further comprising a weave guide mounted in a fixed position with respect to the shedding assembly, the weave guide having a cavity in which the completed weave is received with the cavity being configured such that the completed weave is closely confined therein.

19. A machine according to claim 16 wherein the tensioning assembly includes a guide plate having holes therein, tensioning strings depending from the guide plate at the holes therein, the upper ends of the tensioning strings being attached to the longitudinal strands beyond the guide plate, and weights attached to the lower ends of the tensioning strings.

20. A machine according to claim 19 wherein the tensioning assembly further includes a weight guide having a plurality of vertical upwardly opening cavities in which the weights are confined, whereby the weights and tensioning strings do not become tangled.

21. A weaving machine according to claim 16 wherein the take-up assembly includes shaping means for causing the completed portion of the weave to assume a curved configuration.

22. A weaving machine according to claim 21 wherein the shaping means includes means defining a gate through which the longitudinal strands pass, a weave attachment to which the front ends of the longitudinal strands are attached, the weave attachment be mmounted for rotation about an axis, and actuating means for causing the weave attachment to pivot about the axis.

23. A weaving machine according to claim 22 wherein the shaping means further comrpise at least one weave positioning element located beyond the gate and having a curved surface against which the curved surface of the completed weave bears.

24. A weaving machine according to claim 22 wherein the actuating means includes a bell crank, a screw connected to the bell crank such as to cause the bell crank to rotate, and a link connecting the bell crank with the weave attachment.

* * * * *